US006983869B1

(12) United States Patent
Stevens

(10) Patent No.: US 6,983,869 B1
(45) Date of Patent: Jan. 10, 2006

(54) POUR SPOUT INCLUDING A REMOVABLE LID

(76) Inventor: Peter R. Stevens, 7122 Nelson Street, Apollo Bay, Victoria (AU) 3233

( * ) Notice: Subject to any disclaimer, the term of this patent is extended or adjusted under 35 U.S.C. 154(b) by 30 days.

(21) Appl. No.: 10/880,013

(22) Filed: Jun. 30, 2004

(51) Int. Cl.
*B65D 25/48* (2006.01)

(52) U.S. Cl. ..... 222/570; 220/701

(58) Field of Classification Search ..... 222/566, 222/567, 569, 570; 220/695–701, 731, 733; D9/435, 477; D32/53.1, 54
See application file for complete search history.

(56) References Cited

U.S. PATENT DOCUMENTS

| | | | | | |
|---|---|---|---|---|---|
| 1,746,149 | A | * | 2/1930 | Elsey | 222/545 |
| 1,811,080 | A | * | 6/1931 | Gadke | 222/556 |
| 1,814,083 | A | * | 7/1931 | Flautt | 222/567 |
| 3,356,266 | A | | 12/1967 | Pinter, Jr. | |
| 3,543,287 | A | * | 11/1970 | Henkel | 220/698 |
| 3,853,251 | A | * | 12/1974 | Alpern | 222/475 |
| 4,014,465 | A | * | 3/1977 | Ritter | 222/563 |
| 4,203,537 | A | | 5/1980 | McAlister | |
| 4,240,568 | A | * | 12/1980 | Pool | 222/189.07 |
| 4,312,459 | A | * | 1/1982 | Leach | 220/256.1 |
| 4,907,714 | A | | 3/1990 | Gatz | |
| 5,137,188 | A | | 8/1992 | Thompson | |
| 5,213,239 | A | | 5/1993 | Macaluso | |
| 5,392,969 | A | | 2/1995 | Usery | |
| D456,259 | S | | 4/2002 | Groenewald | |
| 2002/0148863 | A1 | * | 10/2002 | Stoneberg | 222/557 |

* cited by examiner

*Primary Examiner*—Eric Keasel

(57) ABSTRACT

A combination pour spout and lid assembly includes pour spout having a lower portion extending radially across the inner and outer edges of the paint can and includes a locking ridge extending downwardly and inwardly therefrom. A sealing ridge is inwardly spaced from the locking ridge and extends downwardly from the lower portion. The sealing ridge has a notch for receiving the inner edge of the paint can. The pour spout further includes an upper portion integral with the lower portion and defines an obliquely shaped lip. The upper portion further includes a flange portion integral therewith and extending radially outward therefrom. A lid is sized and shaped to cover the pour spout. The lid has substantially planar top and bottom surfaces and a sidewall portion integral therewith and extending downwardly therefrom. The sidewall portion includes a ridge portion integral therewith and extending downwardly and inwardly therefrom.

15 Claims, 4 Drawing Sheets

POUR SPOUT INCLUDING A REMOVABLE LID

CROSS REFERENCE TO RELATED APPLICATIONS

Not Applicable.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Technical Field

This invention relates to pour spouts and, more particularly, to a pour spout including a removable lid for directing paint away from a paint can during operating conditions.

2. Prior Art

The design of conventional paint cans has long been a nuisance to the painter. Paint cans for paint commercially sold are normally filled to the brim; stirring or dipping a brush therein usually causes the overflow of paint into the rim channel and often down the sides of the can, sometimes onto the supporting surface. When paint flows into the rim channel, it may dry and prevent effective resealing of the can by the cover. An inadequate seal allows paint in the can to dry out during storage or may result in spillage if the can is upset.

Sometimes wet paint flows into the rim channel and the can is resealed before the paint has an opportunity to dry. The wet paint dries and acts as a cement, making it difficult to remove the lid from the can at a later time. Because the rim channel is so narrow, it is extremely difficult to clean excess paint out of the rim channel.

Furthermore, design of conventional paint cans does not enhance the pouring of paint. The curvilinear boundary of the inside of the can and the rim channel over which paint must flow makes it difficult to control the flow and to prevent paint from running down the edges of the can.

Moreover, the curvilinear edge of the inner surface of the paint can does not provide a suitable surface for skimming excess paint from a paintbrush. Scraping the brush against the inside surface of the can does not uniformly remove paint from the brush, which in turn does not enhance uniform application of paint to a surface.

Accordingly, a need remains for a combination pour spout and lid that prevents spillage and improves the shelf life of paint cans that have been opened. The present invention satisfies such a need by preventing the spilling and splashing of paint as it is being mixed or poured. It further reduces the amount of time spent cleaning the rims of paint cans so that a tight seal can be maintained for storing the paint.

BRIEF SUMMARY OF THE INVENTION

In view of the foregoing background, it is therefore an object of the present invention to provide an assembly for assisting a user to pour paint from a can. These and other objects, features, and advantages of the invention are provided by a combination pour spout and lid assembly attachable to paint cans and like containers for assisting a user to pour fluid therefrom.

The assembly includes a pour spout removably attachable to a top opening of the paint can and including a lower portion extending radially outwardly from a perimeter of the top portion. The lower portion extends radially across the inner and outer edges of the paint can and includes a locking ridge extending downwardly and inwardly for engaging an outer edge of the paint can and a sealing ridge inwardly spaced from the locking ridge and extending downwardly from the lower portion for engaging an inner edge of the paint can. The sealing ridge extends about a perimeter of the pour spout and has a notch for receiving the inner edge of the paint can and for preventing fluid from exiting the paint can via non-spout routes during operating conditions.

The pour spout further includes an upper portion integral with the lower portion and extending upwardly therefrom. The upper portion defines an obliquely shaped lip for directing fluid outwardly and away from the paint can while preventing the fluid from contacting the outer edge of the paint can. The upper portion further includes a flange portion integral therewith and extending radially outward therefrom and a lid being sized and shaped to cover the pour spout and effectively prevent fluids from exiting the paint can. The pour spout and the lid are preferably formed from plastic material and have a generally tear drop shape to prevent fluid from exiting a container during non-operating conditions.

The lid has substantially planar top and bottom surfaces and a sidewall portion integral therewith and extending downwardly therefrom. The sidewall portion includes a ridge portion integral therewith and extending downwardly and inwardly therefrom and is removably securable to the flange portion of the upper portion.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
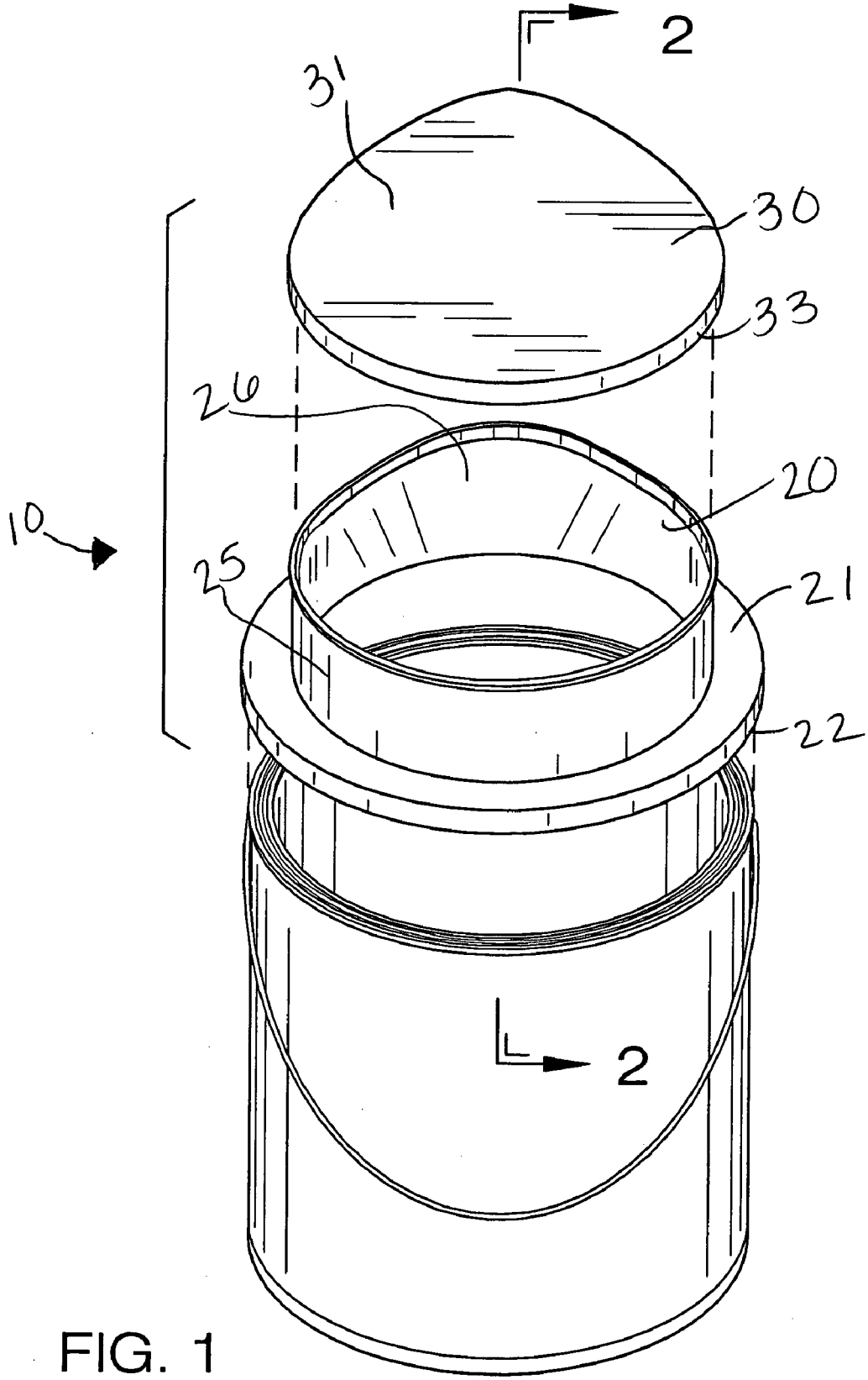
FIG. 1 is a perspective view showing a combination pour spout and lid assembly in a preferred environment, in accordance with the present invention.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art. Like numbers refer to like elements throughout the figures.

The assembly of this invention is referred to generally in FIGS. 1–4 by the reference numeral 10 and is intended to assist a user in pouring paint from a can. It should be understood that the assembly 10 may be used to pour many different types of fluid from different sizes of containers and should not be limited to only conventionally shaped paint cans.

Figure 3:
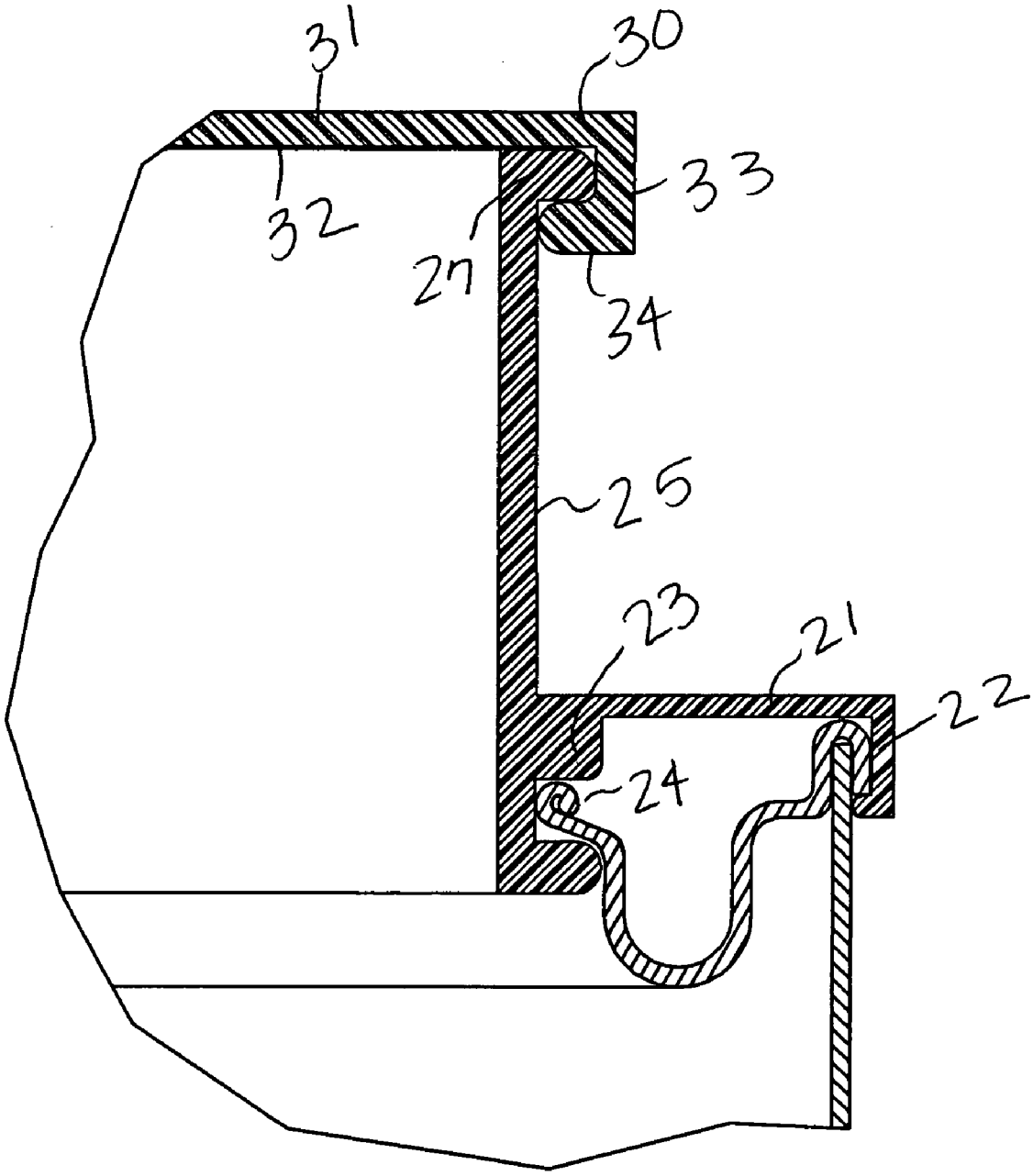
FIG. 3 is a partial cross-sectional view of the assembly shown in FIG. 1 illustrating the sealing of the lid and the lower portion of the spout.

Initially referring to FIGS. 1 and 3, the assembly 10 includes a pour spout 20 removably attachable to a top opening of the paint can and including a lower portion 21 extending radially outwardly from a perimeter of the top portion. The lower portion 21 extends radially across the inner and outer edges of the paint can and includes a locking ridge 22 extending downwardly and inwardly for engaging an outer edge of the paint can and a sealing ridge 23 inwardly spaced from the locking ridge 22 and extending downwardly from the lower portion 21 for engaging an inner edge of the paint can. The sealing ridge 23 extends about a perimeter of the pour spout 20 and has a notch 24 for receiving the inner edge of the paint can and for preventing fluid from exiting the paint can via non-spout routes during operating conditions. The design of the locking ridge 22 makes it easy for a user to snap on and snap off from the paint can.

Figure 2:
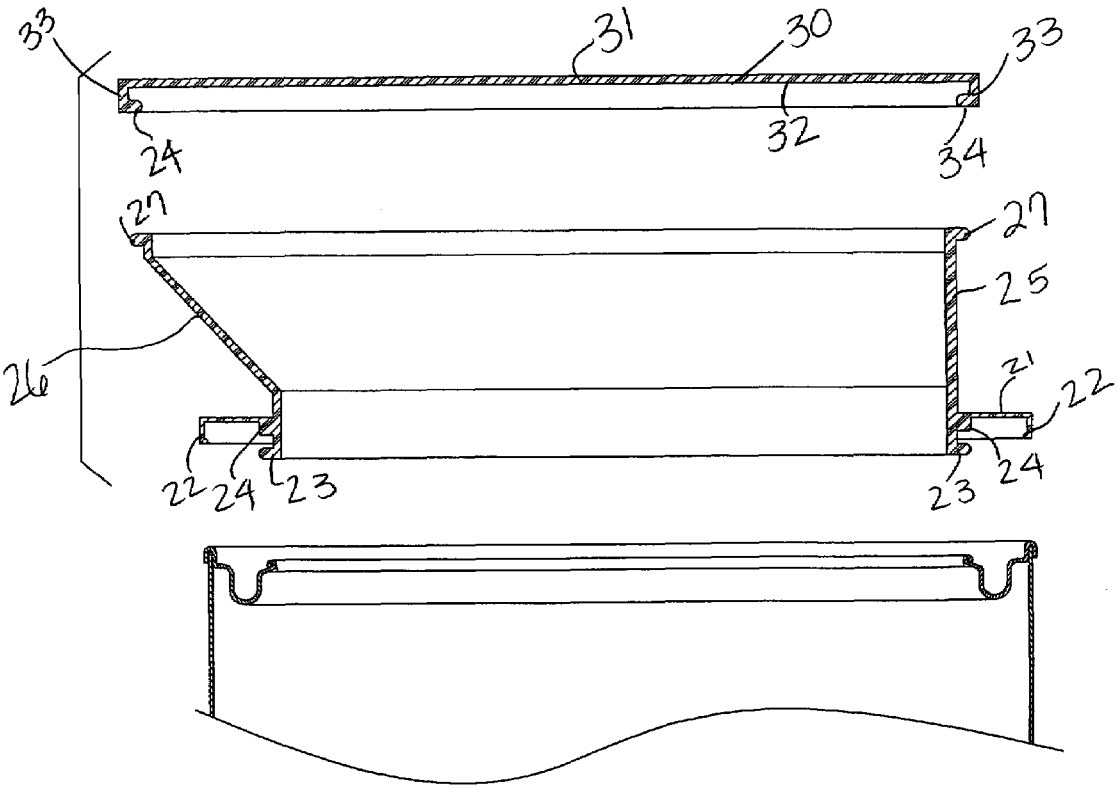
FIG. 2 is a cross-sectional view of the assembly shown in FIG. 1, taken along line 2—2.
Figure 4:
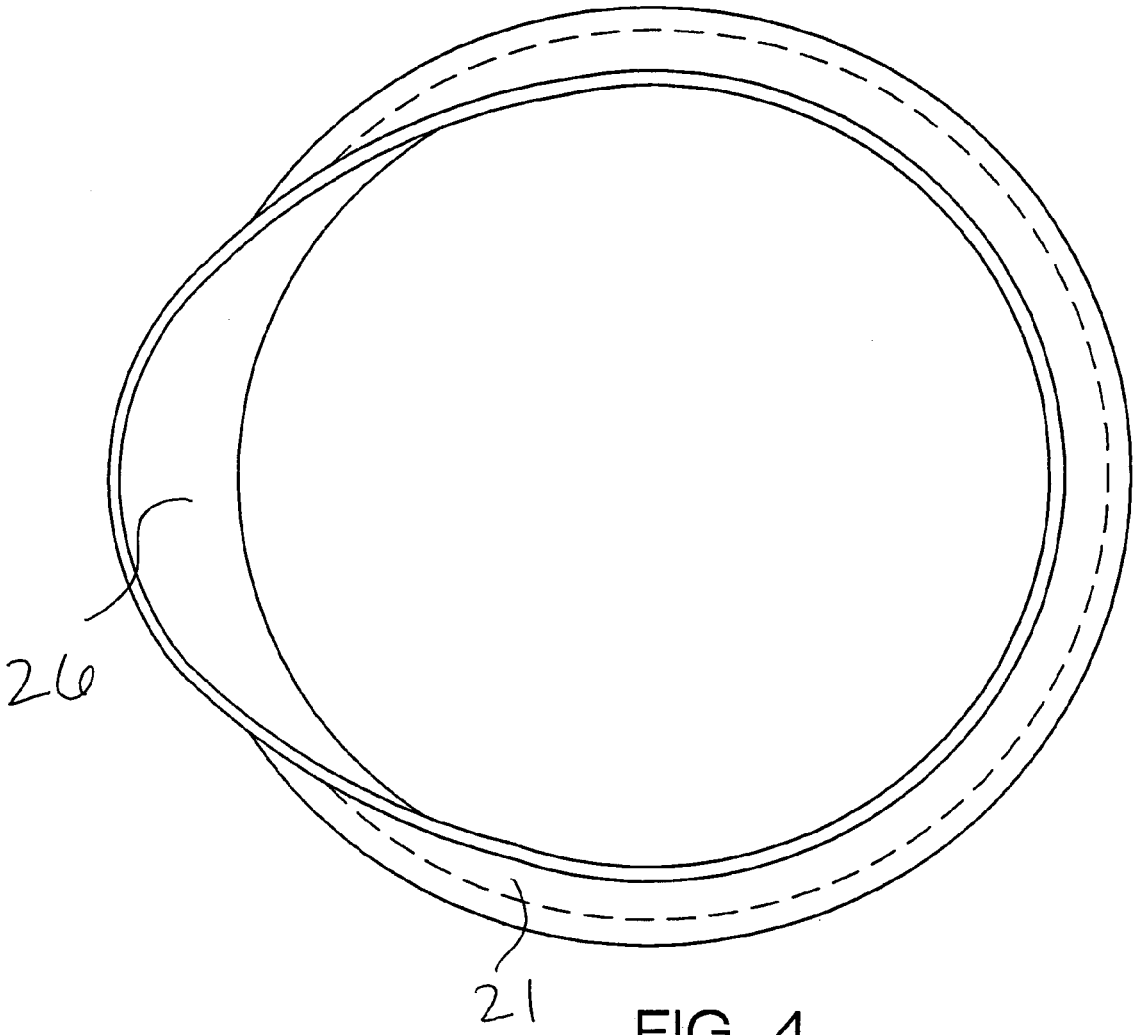
FIG. 4 is a top plan view of the pour spout shown in FIG. 1.

Now referring to FIGS. 2 and 4, the pour spout 20 further includes an upper portion 25 integral with the lower portion 21 and extending upwardly therefrom. The upper portion 25 defines an obliquely shaped lip 26 for directing fluid outwardly and away from the paint can while preventing the fluid from contacting the outer edge of the paint can. This prevents paint from spilling and dripping down the side of the paint can, potentially obscuring important information regarding the contents of such can.

The upper portion 25 further includes a flange portion 27 integral therewith and extending radially outward therefrom and a lid 30 being sized and shaped to cover the pour spout 20 and effectively prevent fluids from exiting the paint can. The pour spout 20 and the lid 30 are formed from plastic material to resist corrosion in an outdoor environment and have a generally tear drop shape to prevent fluid from exiting a container during non-operating conditions. The plastic material further facilitates the clean-up process by providing a surface from which paint is easily removed.

Now referring to FIG. 2, the lid 30 has substantially planar top 31 and bottom 32 surfaces and a sidewall portion 33 integral therewith and extending downwardly therefrom. The lid 30 enables a user to temporarily cap the pour spout 20 without removing it from the paint can so that paint stays fresh while a user takes a lunch or other break. The sidewall portion 33 includes a ridge portion 34 integral therewith and extending downwardly and inwardly therefrom and is removably securable to the flange portion 27 of the upper portion 25.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A combination pour spout and lid assembly attachable to paint cans and like containers for assisting a user to pour fluid therefrom, said assembly comprising:

a pour spout removably attachable to a top opening of the paint can and comprising a lower portion extending radially outwardly from a perimeter thereof, said lower portion having a diameter greater than a diameter of said pour spout, said lower portion comprising a locking ridge extending downwardly and inwardly for engaging an outer edge of the paint can, and a sealing ridge inwardly spaced from said locking ridge and extending downwardly from said lower portion for engaging an inner edge of the paint can;

said pour spout further comprising an upper portion monolithically formed with said lower portion and extending upwardly therefrom, said upper portion defining an obliquely shaped lip for directing fluid outwardly and away from the paint can while preventing fluid from contacting the outer edge of the paint can, said upper portion further including a flange portion integral therewith and extending radially outward therefrom, said upper portion having a circumference less than a circumference of said lower portion, said sealing ridge extending about an outer perimeter of said pour spout; said lower portion having a planar top surface horizontally extending away from said top surface and terminating above the outer edge of the paint can; and a lid being sized and shaped to cover said pour spout and effectively prevent fluids from exiting the paint can, said lid having substantially planar top and bottom surfaces and a sidewall portion monolithically formed therewith and extending orthogonally and downwardly therefrom, said sidewall portion including a ridge portion monolithically formed therewith and extending downwardly and inwardly therefrom, said ridge portion being removably securable to said flange portion of said upper portion.

2. The apparatus of claim 1, wherein said sealing ridge has a notch for receiving the inner edge of the paint can and for preventing fluid from exiting the paint can via non-spout routes during operating conditions.

3. The apparatus of claim 1, wherein said pour spout and said lid are formed from plastic material.

4. The apparatus of claim 1, wherein said lid and said pour spout have a generally tear drop shape to prevent fluid from exiting a container during non-operating conditions.

5. The apparatus of claim 1, wherein said lower portion extends radially across the inner and outer edges of the paint can.

6. A combination pour spout and lid assembly attachable to paint cans and like containers for assisting a user to pour fluid therefrom, said assembly comprising:

a pour spout removably attachable to a top opening of the paint can and comprising a lower portion extending radially outwardly from a perimeter thereof, said lower portion having a diameter greater than a diameter of said pour spout, said lower portion comprising a locking ridge extending downwardly and inwardly for engaging an outer edge of the paint can, said locking ridge being removably securable to the outer edge of the paint can, and a sealing ridge inwardly spaced from said locking ridge and extending downwardly from said lower portion for engaging an inner edge of the paint can;

said pour spout further comprising an upper portion monolithically formed with said lower portion and extending upwardly therefrom, said upper portion defining an obliquely shaped lip for directing fluid outwardly and away from the paint can while preventing the fluid from contacting the outer edge of the paint can, said upper portion further including a flange portion monolithically formed therewith and extending radially outward therefrom, said upper portion having a circumference less than a circumference of said lower portion, said sealing ridge extending about an outer perimeter of said pour spout; said lower portion having a planar top surface horizontally extending away from said top surface and terminating above the outer edge of the paint can; and a lid being sized and shaped to cover said pour spout and effectively prevent fluids from exiting the paint can, said lid having substantially planar top and bottom surfaces and a sidewall portion monolithically formed therewith and extending orthogonally and downwardly therefrom, said sidewall portion including a ridge portion monolithically formed therewith and extending downwardly and inwardly therefrom, said ridge portion being removably securable to said flange portion of said upper portion.

7. The apparatus of claim 6, wherein said sealing ridge has a notch for receiving the inner edge of the paint can and for preventing fluid from exiting the paint can via non-spout routes during operating conditions.

8. The apparatus of claim 6, wherein said pour spout and said lid are formed from plastic material.

9. The apparatus of claim 6, wherein said lid and said pour spout have a generally tear drop shape to prevent fluid from exiting a container during non-operating conditions.

10. The apparatus of claim 6, wherein said lower portion extends radially across the inner and outer edges of the paint can.

11. A combination pour spout and lid assembly attachable to paint cans and like containers for assisting a user to pour fluid therefrom, said assembly comprising:

a pour spout removably attachable to a top opening of the paint can and comprising a lower portion extending radially outwardly from a perimeter of said top opening, said lower portion having a diameter greater than a diameter of said pour spout, said lower portion comprising a locking ridge being integral therewith and extending downwardly and inwardly for engaging an outer edge of the paint can, said locking ridge being removably securable to an outer edge of the paint can, and a sealing ridge inwardly spaced from said locking ridge and extending downwardly from said lower portion for engaging an inner edge of the paint can;

said pour spout further comprising an upper portion monolithically formed with said lower portion and extending upwardly therefrom, said upper portion defining an obliquely shaped lip for directing fluid outwardly and away from the paint can while preventing the fluid from contacting the outer edge of the paint can, said upper portion further including a flange portion integral therewith and extending radially outward therefrom along a substantially orthogonal plane, said upper portion having a circumference less than a circumference of said lower portion, said sealing ridge extending about an outer perimeter of said pour spout; said lower portion having a planar top surface horizontally extending away from said top surface and terminating above the outer edge of the paint can; and a lid being sized and shaped to cover said pour spout and effectively prevent fluids from exiting the paint can, said lid having substantially planar top and bottom surfaces and a sidewall portion monolithically formed therewith and extending orthogonally and downwardly therefrom, said sidewall portion including a ridge portion monolithically formed therewith and extending downwardly and inwardly therefrom, said ridge portion being removably securable to said flange portion of said upper portion.

12. The apparatus of claim 11, wherein said sealing ridge has a notch for receiving the inner edge of the paint can and for preventing fluid from exiting the paint can via non-spout routes during operating conditions.

13. The apparatus of claim 11, wherein said pour spout and said lid are formed from plastic material.

14. The apparatus of claim 11, wherein said lid and said pour spout have a generally tear drop shape to prevent fluid from exiting a container during non-operating conditions.

15. The apparatus of claim 11, wherein said lower portion extends radially across the inner and outer edges of the paint can.

* * * * *